US010518971B2

(12) United States Patent
Butler et al.

(10) Patent No.: US 10,518,971 B2
(45) Date of Patent: Dec. 31, 2019

(54) TRASH RECEPTACLE WITH ATTACHMENT STRAP

(71) Applicants: Pamela A. Butler, Hollywood, FL (US); Michael W. Carter, Hollywood, FL (US)

(72) Inventors: Pamela A. Butler, Hollywood, FL (US); Michael W. Carter, Hollywood, FL (US)

(73) Assignee: Marine 360, LLC, Hollywood, FL (US)

( * ) Notice: Subject to any disclaimer, the term of this patent is extended or adjusted under 35 U.S.C. 154(b) by 871 days.

(21) Appl. No.: 14/947,850

(22) Filed: Nov. 20, 2015

(65) Prior Publication Data

US 2017/0144835 A1 May 25, 2017

(51) Int. Cl.

| | |
|---|---|
| ***B65F 1/00*** | (2006.01) |
| ***B65F 1/06*** | (2006.01) |
| ***B65F 1/14*** | (2006.01) |
| ***B65F 1/16*** | (2006.01) |

(52) U.S. Cl.

CPC ..... *B65F 1/068* (2013.01); *B65F 1/002* (2013.01); *B65F 1/06* (2013.01); *B65F 1/1415* (2013.01); *B65F 1/1452* (2013.01); *B65F 1/1607* (2013.01); *B65F 2001/1676* (2013.01)

(58) Field of Classification Search

CPC .. B65F 1/068; B65F 1/002; B65F 1/06; B65F 1/1415; B65F 1/1452; B65F 1/1607; B65F 2001/1676

USPC ..... 220/495.05

See application file for complete search history.

(56) References Cited

U.S. PATENT DOCUMENTS

| | | | | | |
|---|---|---|---|---|---|
| 3,033,362 | A * | 5/1962 | Marcalus | B65D 5/16 | 206/449 |
| 3,095,087 | A * | 6/1963 | Yates | A47K 10/421 | 206/449 |
| 4,235,350 | A * | 11/1980 | Valentino | A61G 7/0503 | 206/806 |
| D262,422 | S * | 12/1981 | Ortiz | D3/273 | |
| 4,328,904 | A * | 5/1982 | Iverson | B65D 51/24 | 220/200 |
| 4,711,367 | A * | 12/1987 | Albertson | B65F 1/00 | 220/495.08 |

(Continued)

FOREIGN PATENT DOCUMENTS

| | | | |
|---|---|---|---|
| CN | 102320442 | A | 1/2012 |
| CN | 203753722 | U | 8/2014 |

(Continued)

*Primary Examiner* — Ernesto A Grano

(74) *Attorney, Agent, or Firm* — Gould & Ratner LLP

(57) ABSTRACT

The present invention provides a waste receptacle comprising an outer bag having a flexible construction forming an opening at a top side and at least a pair of upper straps capable a third strap for retaining peripheral items, of attaching the receptacle to a rail, a lid attached at a top of bag to close the opening. The receptacle having an inner bag having a backbone circumferentially disposed around the inner bag to help maintain the inner bag in a generally cylindrical shape, the inner bag insertable through the opening of the outer bag and a pull string to disposed at the top of the inner bag being capable to cinch the top of the inner bag closed and a buoyant float member disposed in the outer bag.

17 Claims, 14 Drawing Sheets

(56) References Cited

U.S. PATENT DOCUMENTS 4,948,266 A * 8/1990 Bencic ..... A47L 9/1445 220/495.08
5,022,528 A * 6/1991 Savoy ..... A45C 7/0068 150/108
5,172,838 A * 12/1992 Rowell ..... A45C 11/38 190/103
5,226,576 A * 7/1993 Ellsworth ..... B60R 7/043 224/275
5,362,153 A * 11/1994 Lu ..... B60N 3/08 220/495.06
5,593,059 A * 1/1997 Neilson ..... A47G 29/1203 220/229
D389,682 S * 1/1998 Gene ..... D6/518
5,725,310 A * 3/1998 Kruczko ..... B65D 5/6611 229/117.05
5,749,447 A * 5/1998 Hersh ..... A45C 3/00 190/111
5,803,778 A 9/1998 Hardy
5,860,742 A * 1/1999 Faircloth, Jr. ..... B65D 33/02 220/212
6,074,259 A 6/2000 Lastrajoli et al.
6,273,309 B1 * 8/2001 Oppelt ..... A01K 97/06 2/94
6,427,839 B1 * 8/2002 Helfer-Grand ..... A45C 3/00 150/112
6,439,386 B1 * 8/2002 Sauer ..... B65D 5/4208 206/494
6,656,514 B1 * 12/2003 Tubbs ..... A47J 47/08 220/229
7,073,462 B1 * 7/2006 Layman ..... A01K 27/006 119/161
8,066,118 B1 * 11/2011 Van Tassell ..... B65D 83/0894 206/233
8,365,912 B2 2/2013 Carroscia et al.
8,376,200 B2 * 2/2013 Kim ..... B60R 11/00 224/275
8,887,935 B2 11/2014 Zemitis et al.
9,114,734 B2 * 8/2015 Hackney ..... B60N 3/08
9,840,178 B2 * 12/2017 Baker ..... B65F 1/0006
10,098,335 B2 * 10/2018 Cooper ..... A01K 97/04
2002/0030052 A1 * 3/2002 Joo-Tai ..... A45C 7/0077 220/9.2
2003/0015528 A1 * 1/2003 Schneider ..... A45C 7/0077 220/9.2
2003/0106895 A1 * 6/2003 Kalal ..... B65D 21/086 220/9.2
2004/0159691 A1 * 8/2004 Dingman ..... A45F 3/04 224/656
2006/0131308 A1 * 6/2006 Drake ..... B65F 1/1607 220/229
2007/0025647 A1 * 2/2007 Hamlin ..... B25H 3/00 383/14
2007/0062994 A1 * 3/2007 Shoemaker ..... A41D 13/0012 224/576
2008/0056625 A1 3/2008 Stanton et al.
2008/0060972 A1 * 3/2008 Rappaport ..... A45C 3/06 206/581
2008/0118188 A1 * 5/2008 Jones ..... B65F 1/0006 383/33
2008/0128422 A1 * 6/2008 Adler ..... B60R 7/043 220/495.06
2008/0128460 A1 * 6/2008 Adler ..... B60N 3/08 224/275
2009/0049658 A1 * 2/2009 Takasawa ..... A44B 19/06 24/401
2009/0230258 A1 * 9/2009 McFadden ..... B65B 67/1233 248/101
2009/0249700 A1 * 10/2009 Peterson ..... A45F 3/08 52/2.17
2010/0147918 A1 * 6/2010 Hensley ..... B62J 9/001 224/600
2010/0252560 A1 * 10/2010 Churchill ..... A47G 23/02 220/560
2012/0255983 A1 * 10/2012 Semone ..... A45F 3/04 224/585
2013/0146501 A1 * 6/2013 Zusmanis ..... B65F 1/06 206/525
2016/0009490 A1 * 1/2016 Scherer ..... B65F 1/02 220/523
2016/0060027 A1 * 3/2016 McConnell ..... B65F 1/06 434/236
2016/0060028 A1 * 3/2016 McConnell ..... B65F 1/06 434/236

FOREIGN PATENT DOCUMENTS

FR 2790459 A1 2/1999
GB 2470765 A 8/2010

* cited by examiner

TRASH RECEPTACLE WITH ATTACHMENT STRAP

The present invention relates to trash receptacles and in particular a trash receptacle having an inner bag and strap for attaching peripheral items to the bag or for attaching the bag to a surface.

BACKGROUND

A robust and spill proof waste receptacle is desired in many circumstances. However, many waste receptacles may provide a partial solution. Some receptacles may provide for a safe and secure place to dispose of waste, such as trash and other garbage, but may not be easily accessible or usable by people needing to later move the waste receptacle to a larger garbage bin. For example, in the marine context, it is very detrimental to the environment when waste is spilled from a boat into the water. Even in circumstances where the boaters attempt to place their waste into a receptacle on boat; in rough seas those receptacles can easily go overboard and the waste then escapes the receptacle and enters into the water where it can disrupt the environment. Further, the receptacles that may be used on board a boat do not allow for easy attachment to the boat surfaces and easy removal of the receptacle when the boat is docked. When the waste must be removed from the boat, taken to land and placed in a land based garbage bin there are complications with currently available receptacles. The present invention overcomes many of these disadvantages.

SUMMARY

The present invention is a waste receptacle comprising an outer bag having a flexible construction forming an opening at a top side and at least a pair of upper straps capable of attaching the receptacle to a rail, a lid attached at a top of bag to close the opening, an inner bag having a backbone circumferentially disposed around the inner bag to help maintain the inner bag in a generally cylindrical shape, the inner bag insertable through the opening of the outer bag, a pull string disposed at the top of the inner bag being capable to cinch the top of the inner bag closed and a buoyant float member disposed in the outer bag. A third strap is provided for attaching a peripheral item such as a shoulder strap or providing additional securement means to the boat. The third strap may include a D-shaped ring or a sliding track system.

The straps may have a fastener to clamp sides of the strap together on the rail. The fastener may be a velcro type member on each side of the strap. The backbone may be a plastic or metal wire that is sewn to the inner bag. The float member may be sewn into a bottom panel of the outer bag. The lid may include a slit having flexible sides including a resilient cord disposed along each side of the slit, the slit capable of being stretched apart by at least 1 inch in order to allow for insertion of waste into the interior of the outer bag and to be received by the inner bag, the flexible sides movable between an open and closed position and the sides automatically retractable to the closed position.

An elastic band may be disposed across the top of the outer bag in order to maintain the bag in a collapsed condition. A pair of lower straps may be located along a base of the outer bag. The pair of straps may include fasteners for holding the sides of the straps together and to clamp onto a post. The pair of straps may form a generally cylindrical area capable of receiving a rail or other mounting member therein and the cylindrical area having an axis disposed in a generally vertical orientation with respect to the receptacle. The pair of upper straps may form a generally cylindrical area capable of receiving a rail or other mounting member therein and the cylindrical area having an axis disposed in a generally horizontal orientation with respect to the receptacle. A band may be disposed at the bottom of the outer bag and for maintaining the buoyant member within the outer bag. A rigid plate may be disposed on a back panel of the outer bag.

A zipper disposed along a top edge of the opening of the outer bag may fasten the lid in a closed condition. At least a pair of zipper pulls may be provided for opening and closing the zipper. A locating device may be disposed within the receptacle including one of a transmitter, light emitting device and reflector so that the receptacle may be more easily located if the receptacle is floating in water.

In an embodiment, an outer bag is provided having a lid attached at a top of the outer bag to close an opening at the top of the bag, the outer bag formed from a flexible material capable of orienting the outer bag between a collapsed and upright condition. An inner bag formed of a flexible nylon material is provided and the inner bag is insertable through the opening of the outer bag; and a buoyant float member is disposed in the outer bag and a strap to secure a peripheral item. The lid may be hingedly attached to the outer bag, the lid including a slit having flexible sides including a resilient cord disposed along each side of the slit, the slit capable of being stretched apart by at least 1 inch in order to allow for insertion of waste into the interior of the outer bag and to be received by the inner bag, the flexible sides movable between an open and closed position and the sides automatically retractable to the closed position.

In an embodiment, the invention provides a method of managing waste material to avoid polluting water systems comprising the steps of providing an outer bag having a lid attached at a top of the outer bag to close an opening at the top of the bag, a slit formed in the lid, a pair of straps disposed on the outer bag, an inner bag formed of a flexible nylon material, the inner bag inserted through the opening of the outer bag and a buoyant float member disposed in the outer bag, mounting the outer bag to a rail of a boat by fastening the pair of straps around the rail, zipping the lid in a closed condition so that in case of rough water affecting the orientation of the outer bag, the outer bag will maintain waste disposed inside the outer bag, disposing of waste material within the inner bag by inserting through an expandable slit formed in the lid, accessing the inner bag when full by unzipping the lid of the outer bag in order to flip the lid upward and expose the inner bag, cinching a pull string on the inner bag to close the top of the inner bag, pulling the inner bag through the opening of the outer bag, grabbing a strap of the inner bag attached via a peripheral item strap and carrying the inner bag off the boat and emptying the waste material of the inner bag into a garbage bin on land. The method may further comprise the step of registering the boat as an environmentally compliant vessel, being equipped with a water friendly waste receptacle and attaching a shoulder strap to a metal or plastic D-shaped clip attached to a third strap extending from the top of the outer bag.

Figure 1:
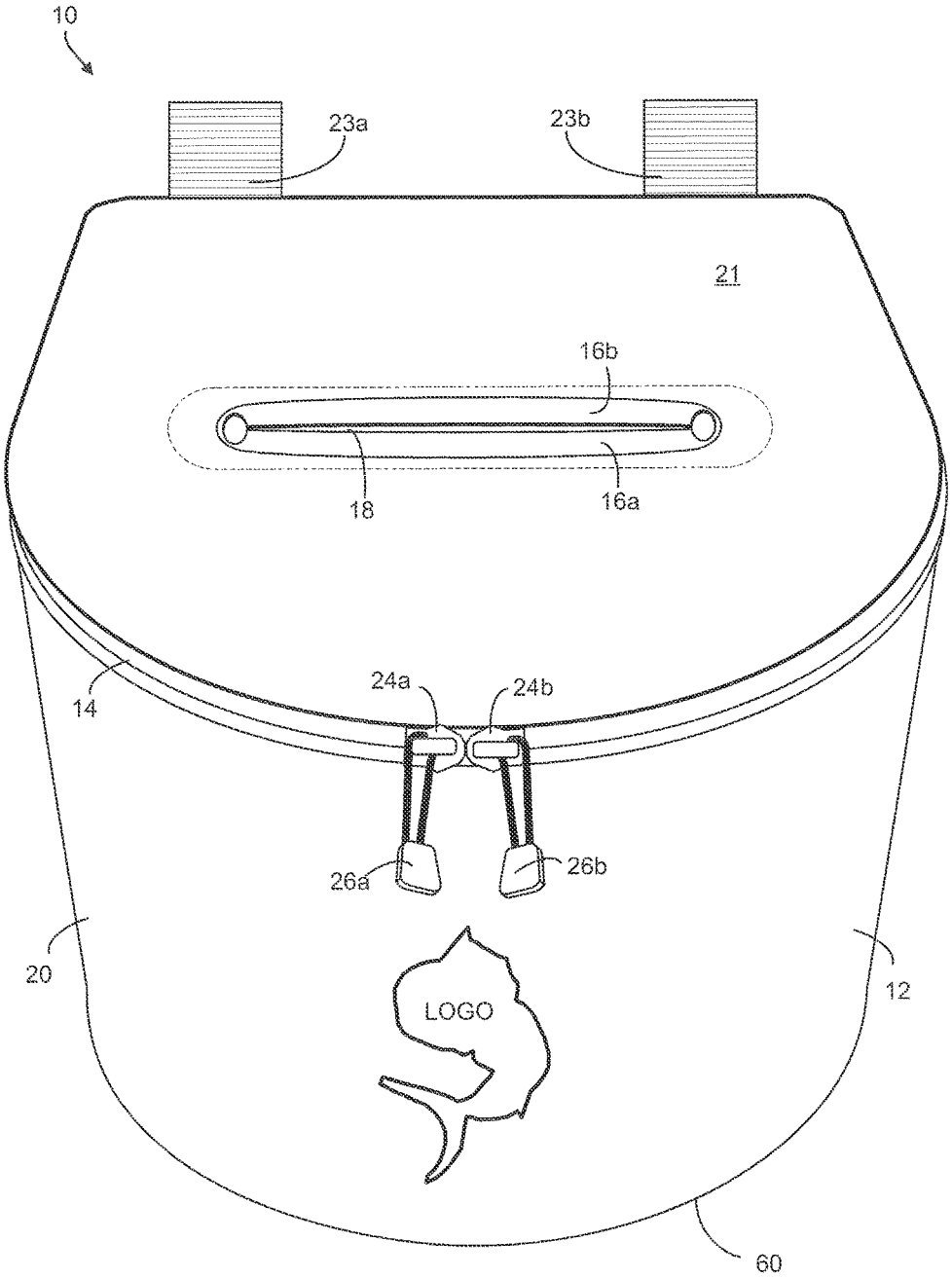
FIG. 1 is a perspective view of the waste receptacle of the present invention.

While the invention is amendable to various modifications and alternate forms, specific embodiments have been shown by way of example in the drawings and will be described in detail. It should be understood that the intention is not to limit the invention to the particular embodiments described. The intention is to cover all modifications, equivalents and alternatives falling within the spirit and the scope of the invention.

DETAILED DESCRIPTION

A marine soft-sided trash receptacle assembly 10 comprised of two primary components of an exterior bag assembly 20 and interior bag 40 as shown in FIGS. 1-7. The primary purpose of the bag is to gather harmful refuse that compiles during a fishing/boating/aquatic trip to reduce waste such as paper, plastics and aluminums trash that are commonly found floating in the ocean and lakes.

The exterior bag 20 is made of a water resistant sunbrella material or the like. The exterior bag has four nylon straps 23*a,b*, 34*a,b* which fasten closed around a rail or hook of a boat or vehicle such as by using a Velcro fastener. In an alternate embodiment, a plastic clip or fastener closes the sides of the strap. The over lapped lid 21 extends from the top edge 24 of the body 12 to securely shut, for example by closing a zipper while the boat is in motion. In an embodiment, the exterior bag 20 may be decorated with an embroidered marine figure. Four nylon straps 23*a,b*, 34*a,b* total are secured by fasteners such as Velcro. In an embodiment, the straps may be lined with slip-resistant material. A single strap or combination of one or all straps may be used to secure the bag 10 in its desired location on the vessel.

The base of the soft-sided exterior bag is equipped with a floating device 51 built into it made from a plastic foam material such as polyvinyl and polyethylene or the like. This floating device helps to ensure the securely enclosed trash will not end up at the bottom of the ocean. In emergency cases this floating feature may also assist in a man-overboard situation.

The interior component 40 to the soft-sided trash receptacle is what will actually contain the debris. This interior bag is designed to allow the exterior bag to stay in place on the vessel, during removal of the interior bag filled with debris. Tightening a drawstring ensures no spillage and the interior bag may be taken to proper disposal locations. The interior bag 40 is made of a tightly woven water resistant fabric such as nylon or polyester (similar to an umbrella) and sits with in the exterior bag. This oblong shaped bag will be self standing by way of polyamide plastic or coated metal fabricated coil 50 with the strength to hold the bag standing and will be sewn into the polyester fabric of the bag from the top rim to bottom rim to give the bag 40 the upright position needed to stand when empty.

The interior bag 40 will have the nylon material slack at the top 43 several inches without the sewn in coil interior and just a drawstring 41 that can securely lock closed 42 at the outer limit to function as a closing devise for the interior bag. Affixed externally to this interior bag will be a fabric handle 44 made of a nylon material or the like for easy carrying. FIG. 1 depicts the receptacle 10 including the outer bag 20 that is formed by an outer wall having a semicircular shape on the front side and a flat surface on the back side 13. In an embodiment, the material for the outer bag 20 is water resistant and flexible. The top, including top rear edge 24 (FIG. 5) and top edge 14 of the opening (FIG. 2) of the outer bag 20 is enclosed by a lid 21. The lid 21 includes a slit 18 which is formed by a pair of flexible sides 16. Each side 16 may include a resilient cord running from each end of the slit 18. The resilient sides 16 are capable of being flexed outward to separate the slit 18 for the insertion of waste through the lid 21. In an embodiment, the sides 16 can flex at least one inch in order to insert waste there through. As depicted in FIG. 1 the slit is in the closed position. The slit 18 is also capable of being in an open position when a user inserts her hand into the slit 18 causing the sides 16*a,b* to separate and move to an open position. In an alternate embodiment the slit 18 may be provided by a Zipper, Velcro, a magnet trim, buckle, plastic, snaps, rubber or plain fabric.

The resilient nature of the sides 16*a,b* will cause the sides to automatically retract and close the slit 18. This feature of the lid allows for the securement of waste within the outer bag 20. In the case of rough seas, where the bag 10 is thrown about and not oriented in a level orientation, the waste will still be retained within the inside of the outer bag 20 due to the closed slit 18. As well, if the receptacle were to break free of its mounting position on a rail or stanchion of a boat and land in the water, it will continue to maintain the waste articles within the interior bag 40 due to the resilient nature of the slit 18 being maintained in a closed position. The lid 21 is secured to the body of the outer bag 20 using any known means of fastening. In an embodiment, as shown in FIG. 1, a zipper is used at the top edge 14 of the body of the outer bag 20. Zipper members 24*a,b* run along the edge of the opening 14. Zipper pulls 26*a,b* may be grasped by fingers to easily zip and unzip the lid. In the fully zipped position as shown in FIG. 1, with the zipper members 24*a,b* side by side, the lid 21 is securely fastened to the body of the outer bag 20. No waste can escape through the side edge 14 when zipped. In an alternate embodiment, the zipper function may be provided by Velcro, cloth flap overlap, buckles, snaps or a pull string.

Figure 2:
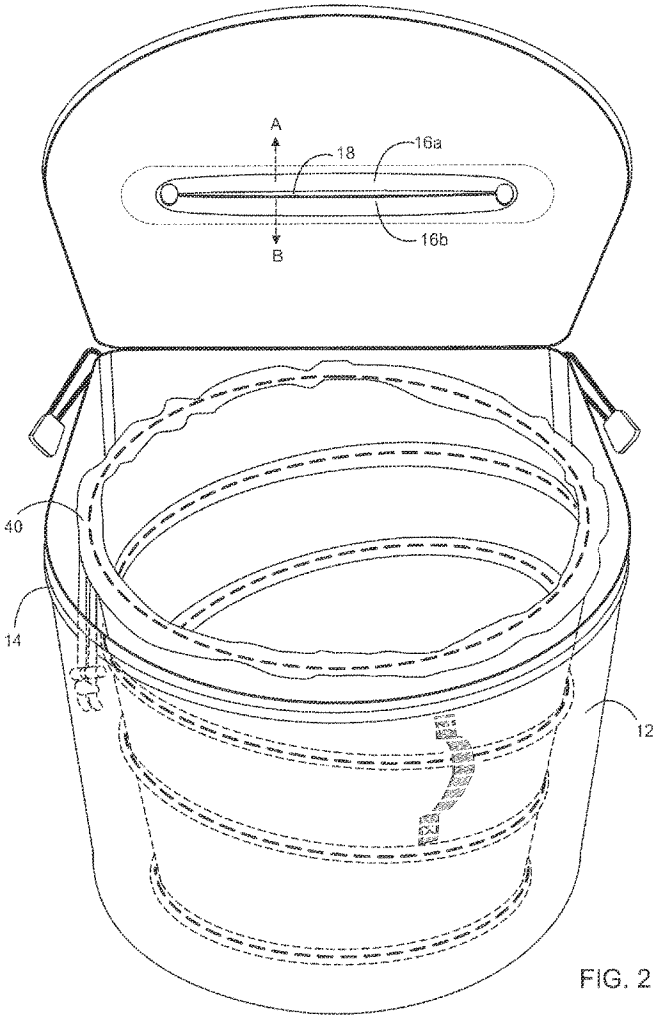
FIG. 2 is a perspective view of the waste receptacle of FIG. 1, having the lid in the open position to reveal the inner bag disposed within the outer bag.
Figure 5:
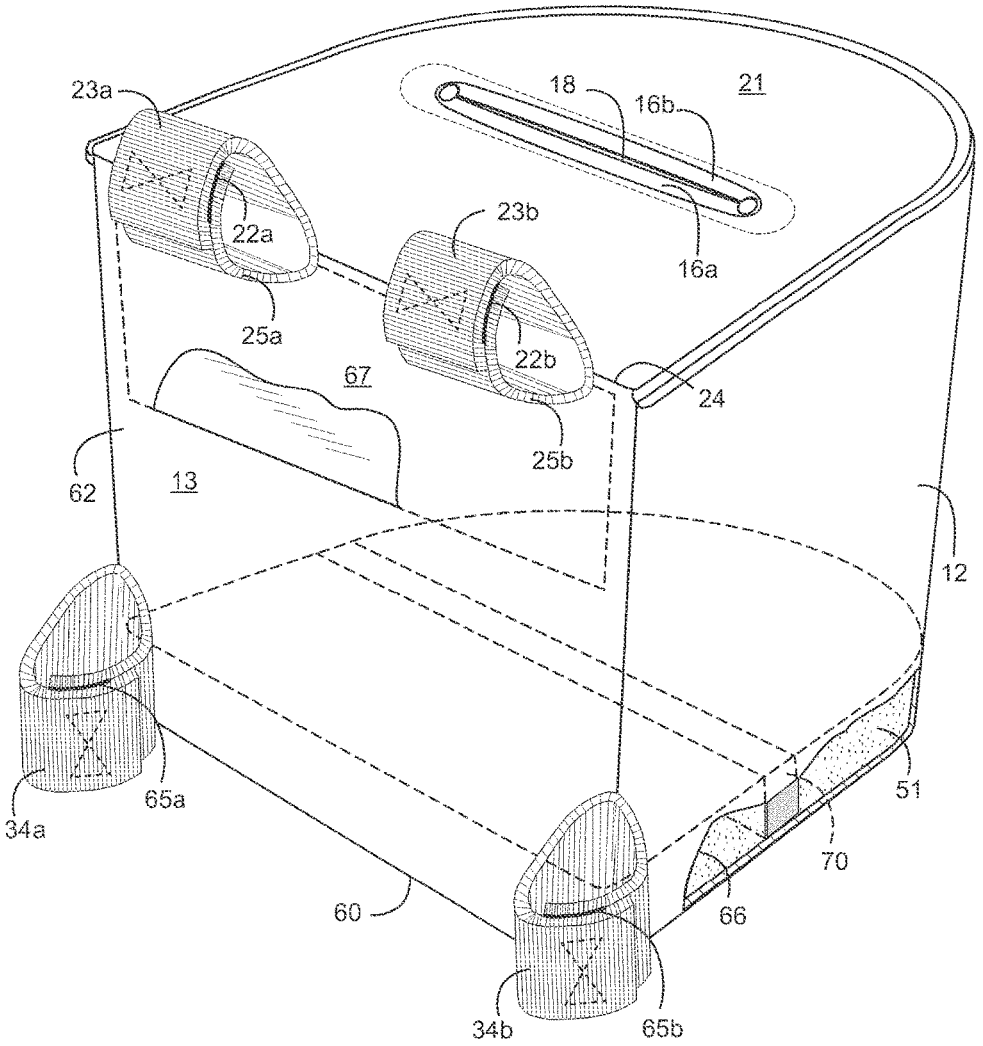
FIG. 5 is a perspective partially transparent view of the rear of the outer bag of FIG. 1.

Turning to FIG. 2, the outer bag 20 is shown with the lid 21 depicted in the open position. The lid 21 is hingedly attached at edge 24 (FIG. 5) to the body of the outer bag 20. The zippers have been moved around along the upper edge 14 of the opening and are in the open most position as shown by the zipper pulls 24*a,b*, towards the backside 13 of the outer bag. The lid 21 shows the underside of the slit 18 and the resilient sides 16*a,b* of the slit. The inner bag 40 is depicted in its assembled position within the interior of the outer bag 20. Straps 23*a,b*, 34*a,b* are depicted along the backside of the outer bag 20 (FIG. 5). In an alternate embodiment, the function of the straps may be provided by a nut and bolt mounting bracket, D-clamps, rope/ties, buckles, snaps, zip ties, l-brackets, cargo straps, rivets or Keder Rails System or the like.

Figure 3:
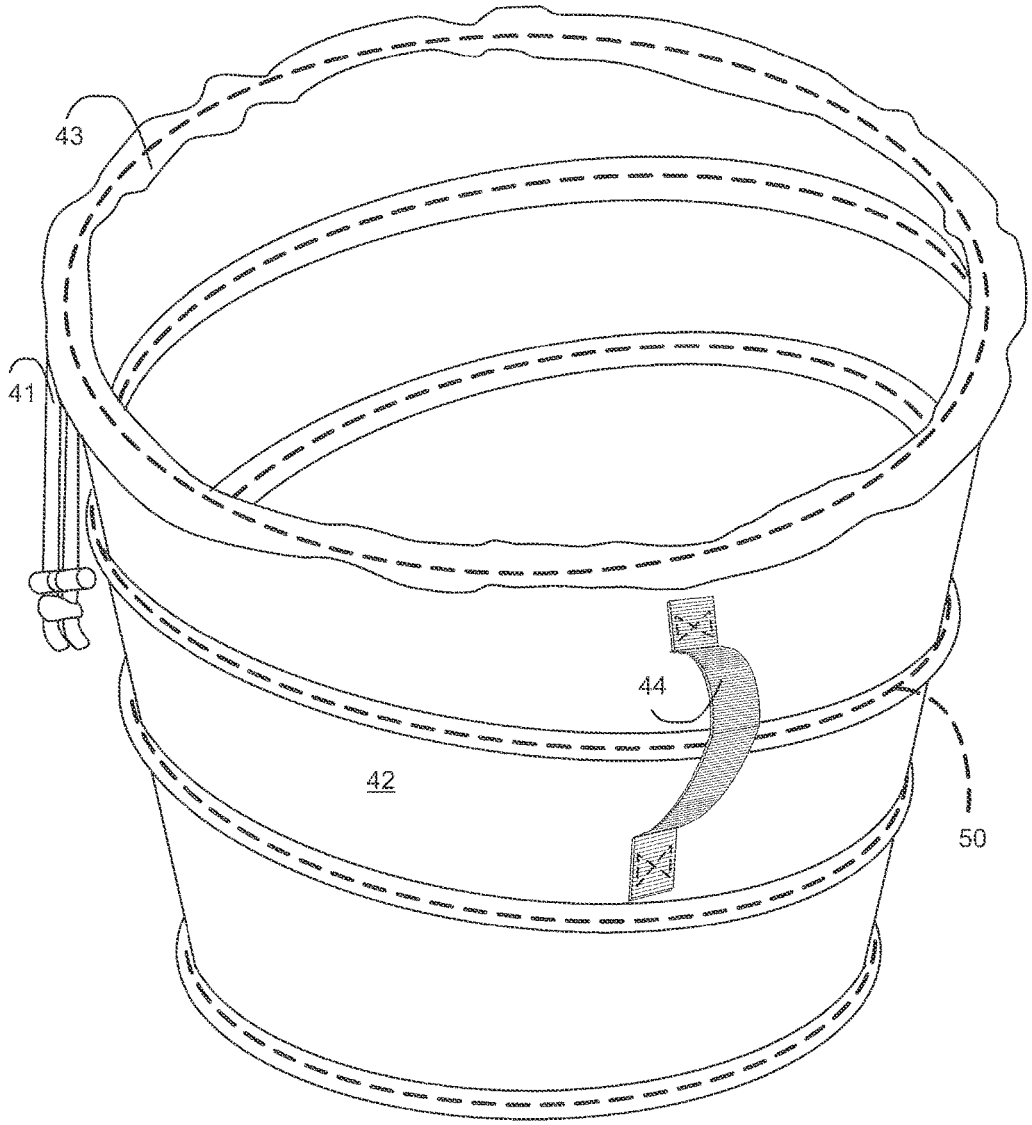
FIG. 3 is a perspective view of the inner bag of the present invention.

Turning to FIG. 3, the inner bag 40 will be described in more detail. The inner bag includes an upper edge 43 where lose material of the bag is gathered. A pull string 41 is provided that runs around the circumference of the upper edge 43. The inner bag 40 includes a sidewall 42 which includes circumferential rib 50 disposed in order to maintain the inner bag in an upright orientation. In an embodiment, the rib 50 may be formed of a metal or plastic wire which circumferentially encircles the side wall 42 of the inner bag 40. In an embodiment, the rib 50 may be sewn into the fabric of the inner bag 40. In an embodiment, the inner bag 40 may be formed of a nylon material. A handle 44 is attached to the sidewall 42 of the inner bag 40. In an alternate embodiment, the circumferential rib 50 may be provided by metals such as stainless steel or nickel plated steel, plastic, air (like blown up tube), draw string or an elastic member.

Figure 4:
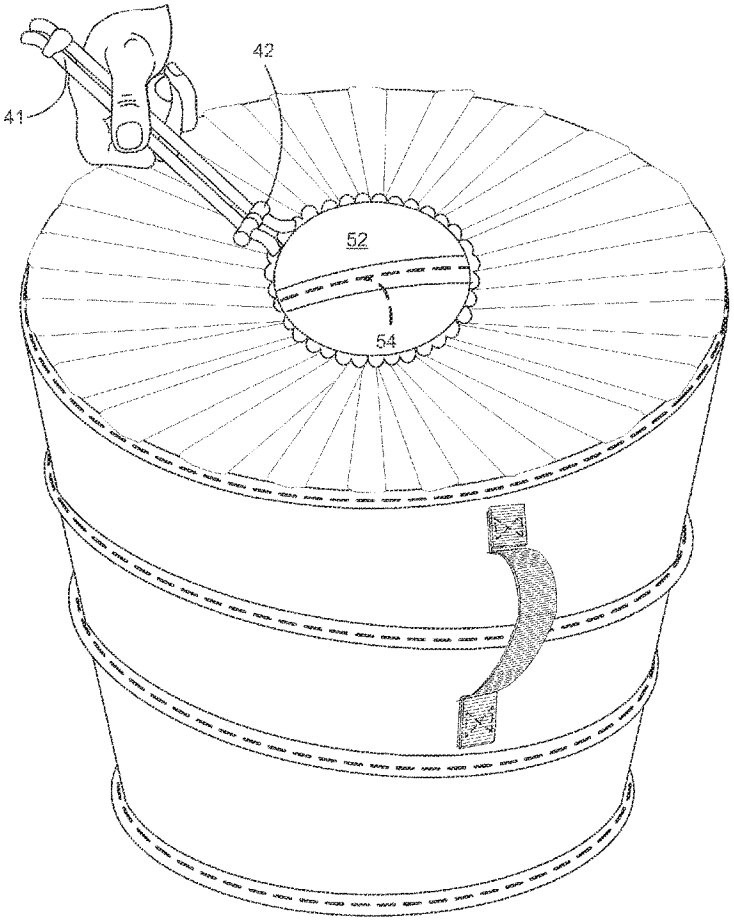
FIG. 4 is a perspective view of the inner bag of FIG. 3 showing the top cinched closed.

Turning to FIG. 4, the inner bag 40 is shown with its top in a closed position where the drawstring 41 has been pulled taught and the center crown 52 is enclosing the center of the top portion of the inner bag 40. A band 54 holds the crown 52 in a flat position. The drawstrings 41 include retainer 42 in order to grab the strings 41 and hold them in position, so that the top of the inner bag 40 remains closed. In an alternate embodiment, an elastic member may be used to pull tight the top of the inner bag 40.

In a preferred use of the receptacle 10, the waste material is inserted through the slit 18 of the lid 21 of the outer bag 20 into the inner bag 40 while the top opening of the inner bag is in an open position. When it is desired to empty the waste, the pull string 41 is pulled-tight to cinch the top of the material to the closed position as show in FIG. 4 enclosing all the waste material in the inner bag 40. The inner bag 40 is then removed from the outer bag 20 and the handle 44 may be used to carry the inner bag 40 off of a boat or other place where waste is collected for disposal.

FIG. 5 depicts a rear view of the outer bag 20 which includes a rear wall 13 that defines the body of the outer bag including the side wall 12. The rear wall 13 and side wall 12 form an opening which is enclosed by the lid 21. The lid includes slit 18 having sides 16*a,b*. At the edge where the lid is hinged 24 there are located straps 23*a,b*. The straps are formed having two sides 25*a,b*, each side being separable. A fastener is provided at the edge of each side 25*a,b*, to attach the sides together so that the strap 23*a,b* may fasten onto a mounting member such as a rail on a boat. In an embodiment, the fastener 22*a,b* may be a Velcro type member that will attach the first side 25*a,b* to the second side 22*a,b* of the strap 23*a,b*, so that the strap 23*a,b* may be easily opened and closed and wrapped around a rail. The lower strap 34*a,b* also includes a fastener 65*a,b* and operates as discussed above for upper straps 23*a,b*.

As depicted in FIG. 5, it can be seen that the straps 23*a,b* form generally a cylindrical area within the strap and the axis of the cylindrical area is horizontally oriented with respect to the outer bag 20. It may be understood that the straps 23*a,b* are most suitable for attaching the outer bag to a horizontal rail or chair on a boat or other vehicle. The upper straps 23*a,b*, are formed of a rugged nylon material that can resist tearing and firmly attach to the backside 13 of the outer bag 20, such as by sewing or adhesive.

The outer bag 20 also includes lower straps 34*a,b* which operate in a similar fashion as described above with respect to the upper straps and include fasteners 65*a,b*. As depicted in FIG. 5, the straps 34*a,b* have a generally cylindrical area therein having an axis that is generally vertically oriented with respect to the outer bag 20. It may be understood that the lower straps 34*a,b* are best suited to attach to a rail or other member of a boat that has a vertical orientation. With the combination of the upper straps and lower straps 34*a,b* a suitable mounting may be achieved in most any situation for a boat or a vehicle that has either a vertical or horizontal mounting member such as a rail or rigging. The backside 62 of the outer bag 20 also includes a rigid plate 67 to help support the outer bag 20 and provide for a robust back surface 62.

In an alternate embodiment, the rigid plate may be formed from PVC, plastic, cardboard, fiber glass, metals or heavy duty rubber. The base 60 of the outer bag 20 includes a buoyant member 51 such as a foam insert that may or may not be disposed in a compartment 66 formed at the base 60 of the outer bag 20. In an embodiment, a strap 70 may be provided to maintain the buoyant member 51 in a position at the base of the outer bag 20.

Figure 6:
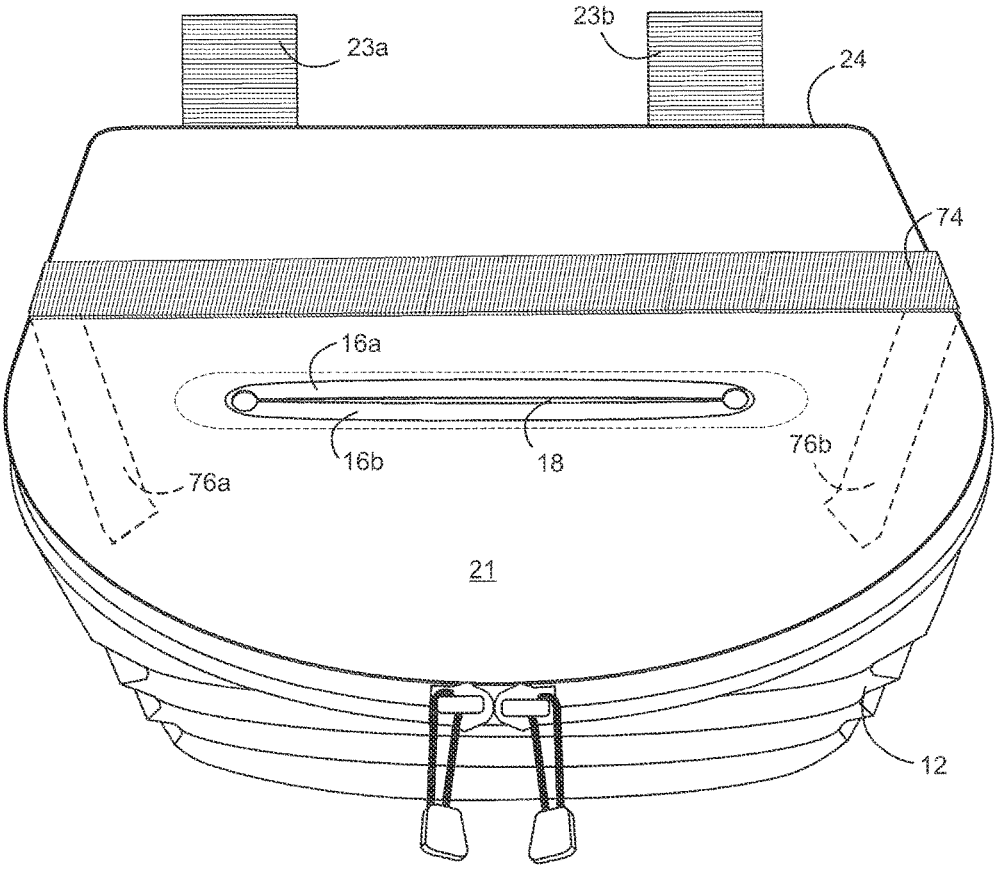
FIG. 6 is a perspective view of the waste receptacle of FIG. 1 in a collapsed condition.

Turning to FIG. 6, the bag is depicted in collapsed condition where the side wall 12 can be shown having an accordion type condition where the base 60 is oriented more closely to the lid 21. When the receptacle 10 is being transported from someone's home to a boat, or other transport it may be desirable to have the receptacle in the collapsed position so that it takes up less space. In an embodiment, an elastic strap 74 is provided to maintain the receptacle in the collapsed position. The strap 74 includes retention member 76*a,b* that help retain strap 74 on the sides 12 of the outer bag 20 and help to pull the lid 21 downward toward the base 60 to maintain the receptacle in the collapsed condition.

Figure 7:
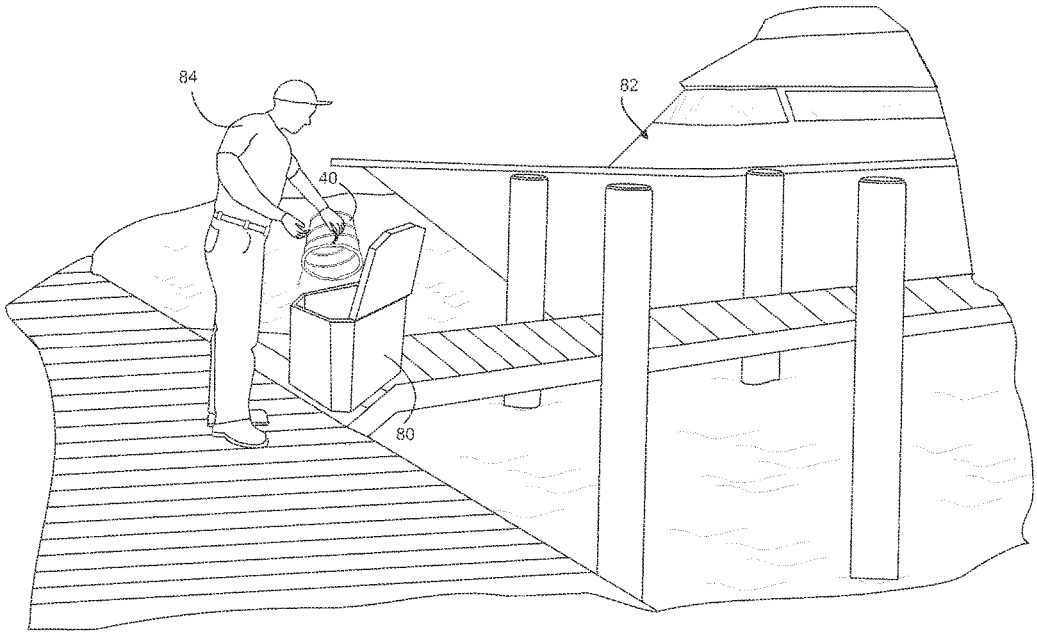
FIG. 7 is a depiction of an environment where the receptacle may be used and depicting the inner bag being emptied into a garbage bin on land.

Turning to FIG. 7, the use of the receptacle may be understood. The receptacle having been mounted on the boat 82 has been removed and the boater 84 has carried the inner bag 40 off of the boat 82 after removing it from the outer bag. The drawstring as depicted in FIG. 7 has been withdrawn so that the top of the inner bag 40 is opened and the waste material from within the inner bag 40 may be dumped into a garbage bin 80 on land, on the dock. Thus, it may be understood that the use of the receptacle 10 is easily accomplished and following the emptying of the inner bag 40 it may be quickly be returned to the boat and the outer bag 20 which may be maintained in its mounted position on the boat. The receptacle provides an environmentally friendly means of managing waste so that the waste collected from a boat trip does not end up in the water. In the situation where there are rough seas it is important that the waste does not end up in the water, but ends up in the garbage bin 80 where it can be properly removed to a at a landfill. In some circumstances an environmentally friendly receptacle and certification of the boat as an environmentally responsible vessel may be achieved by using the waste receptacle of the present invention.

Figure 8:
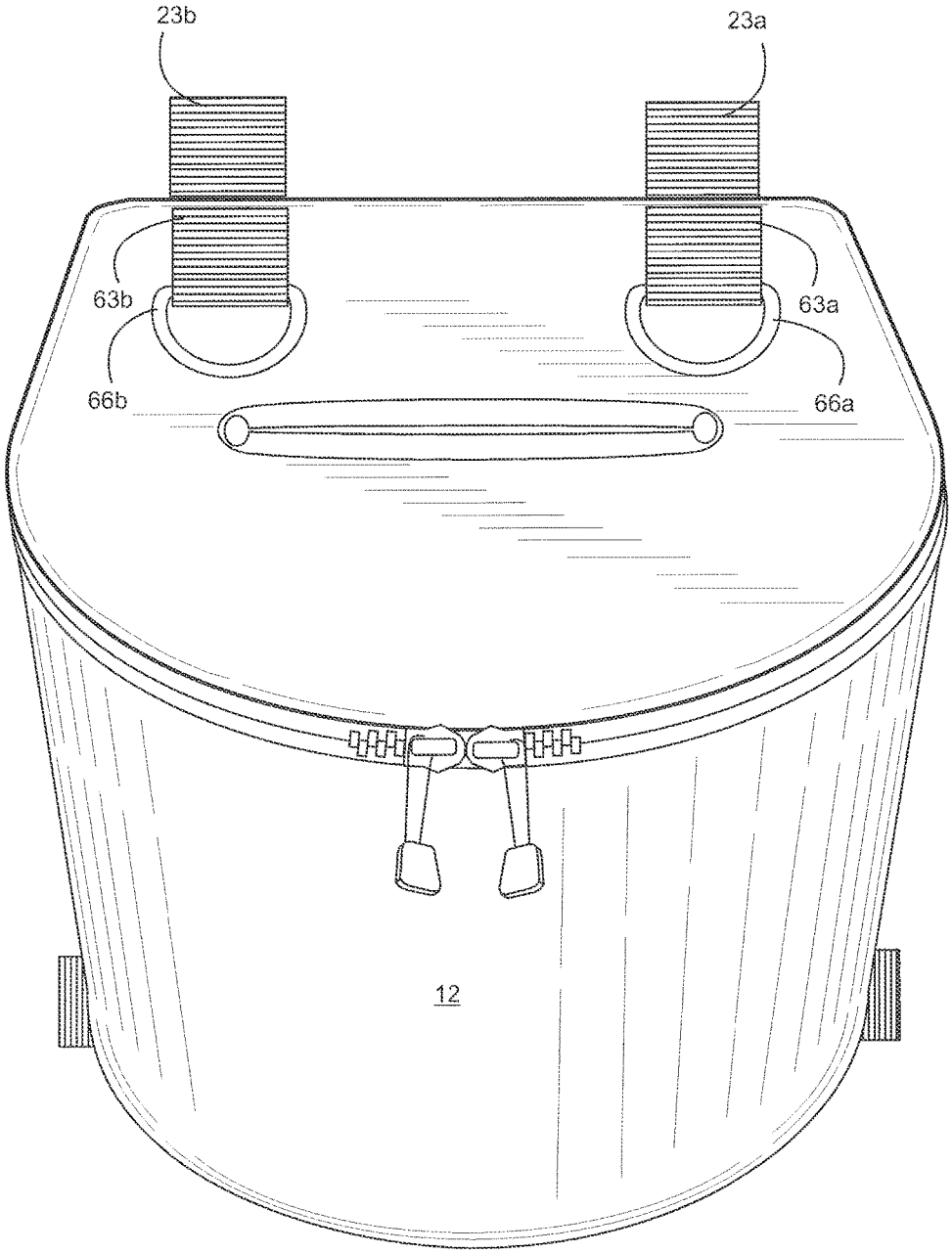
FIG. 8 is a perspective view of a waste receptacle depicting peripheral item straps.

FIG. 8 depicts a perspective view of the waste receptacle formed of a side wall 12 and disposed on the lid are a pair of first upper straps 23*a,b* and a pair of second attachment straps such as peripheral item straps 63*a,b*. Each attachment strap 63*a,b* includes an attachment member 66*a,b* such as a metal or plastic D-shaped ring.

Figure 9:
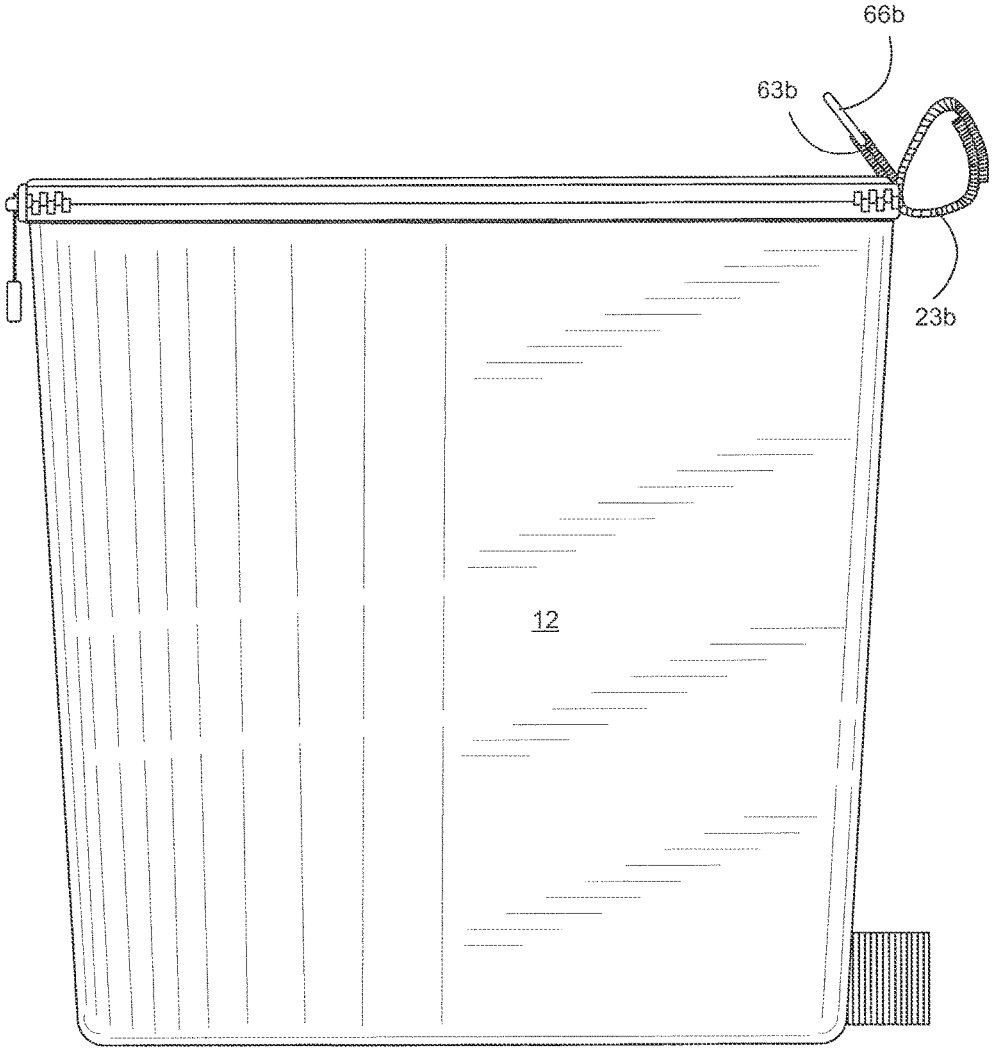
FIG. 9 is a side view of the waste receptacle of FIG. 8 depicting the peripheral item straps.

FIG. 9 depicts a side elevation view of the waste receptacle having on the lid the first upper strap 23*b* and second attachment strap 63*b*. Each attachment strap 63*b* includes an attachment member 66*b* such as a metal or plastic D-shaped ring.

Figure 10:
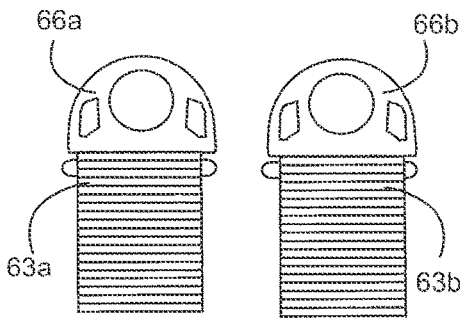
FIG. 10 is a plan view of the peripheral item straps removed from the waste receptacle.
Figure 11:
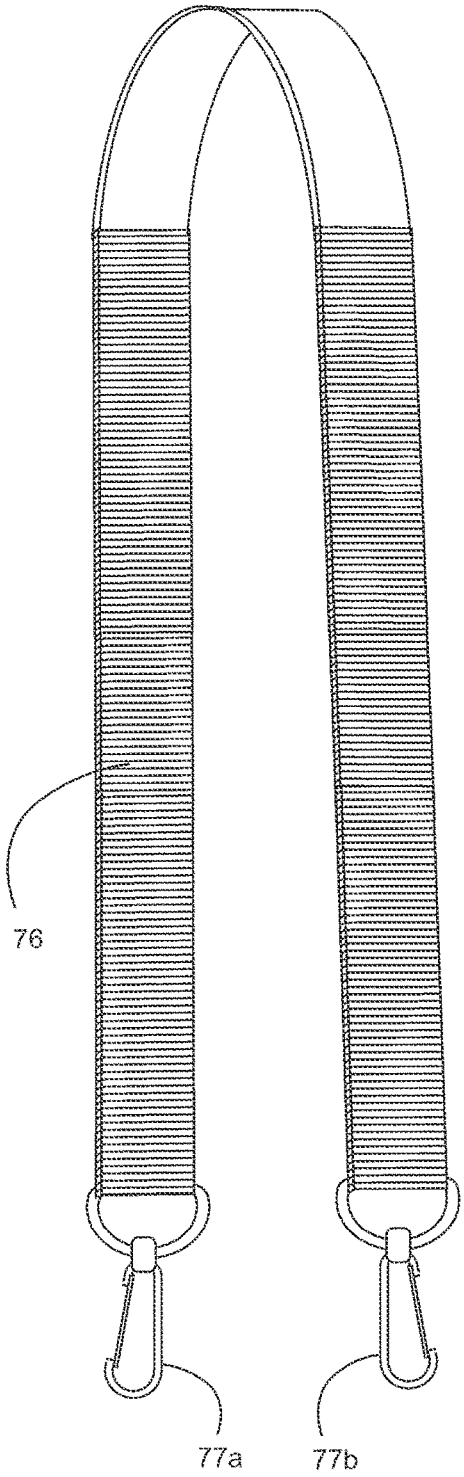
FIG. 11 is a plan view of a peripheral item, such as a shoulder strap.

FIG. 10 depicts a plan view of the attachment straps 63*a,b* removed from the waste receptacle and each having a D-shaped ring 66*a,b*. A peripheral item 76 is depicted in FIG. 11. In the example depicted, the peripheral item is a shoulder strap 76. The shoulder strap includes metal or plastic clips 77*a,b* for attaching to the attachment members 66*a,b*, as depicted in FIGS. 8 and 9. In an alternate embodiment, the peripheral item may be a hand strap, supplemental bag, transponder or transponder holder, light, float device, credential holder or key ring.

FIGS. 12-15 depict an alternative embodiment of the present invention. A marine soft-sided trash receptacle assembly 110 comprised of two primary components of an exterior bag assembly 120 and an interior bag. The primary purpose of the bag is to gather harmful refuse that compiles during a fishing/boating/aquatic trip and to be able to quickly and easily mount the receptacle bag to a surface of a boat or other vehicle or attach peripheral components to the bag.

The exterior bag 120 is made of a water resistant sunbrella material or the like. The exterior bag has four nylon straps 123*a,b*, 134*a,b* which fasten closed around a rail or hook of a boat or vehicle such as by using a Velcro fastener. In an alternate embodiment, a plastic clip or fastener closes the sides of the strap. The over-lapped lid 121 extends from the top edge 124 of the body 112 to securely shut, for example by closing a zipper while the boat is in motion. Four nylon straps 123*a,b*, 134*a,b* are secured by fasteners such as Velcro. In an embodiment, the straps may be lined with slip-resistant material. A single strap or combination of one or all straps may be used to secure the bag 110 in its desired location on the vessel.

The base of the soft-sided exterior bag is equipped with a floating device built into it made from a plastic foam material such as polyvinyl and polyethylene or the like. This floating device helps to ensure the securely enclosed trash will not end up at the bottom of the ocean. In emergency cases this floating feature may also assist in a man-overboard situation.

Figure 12:
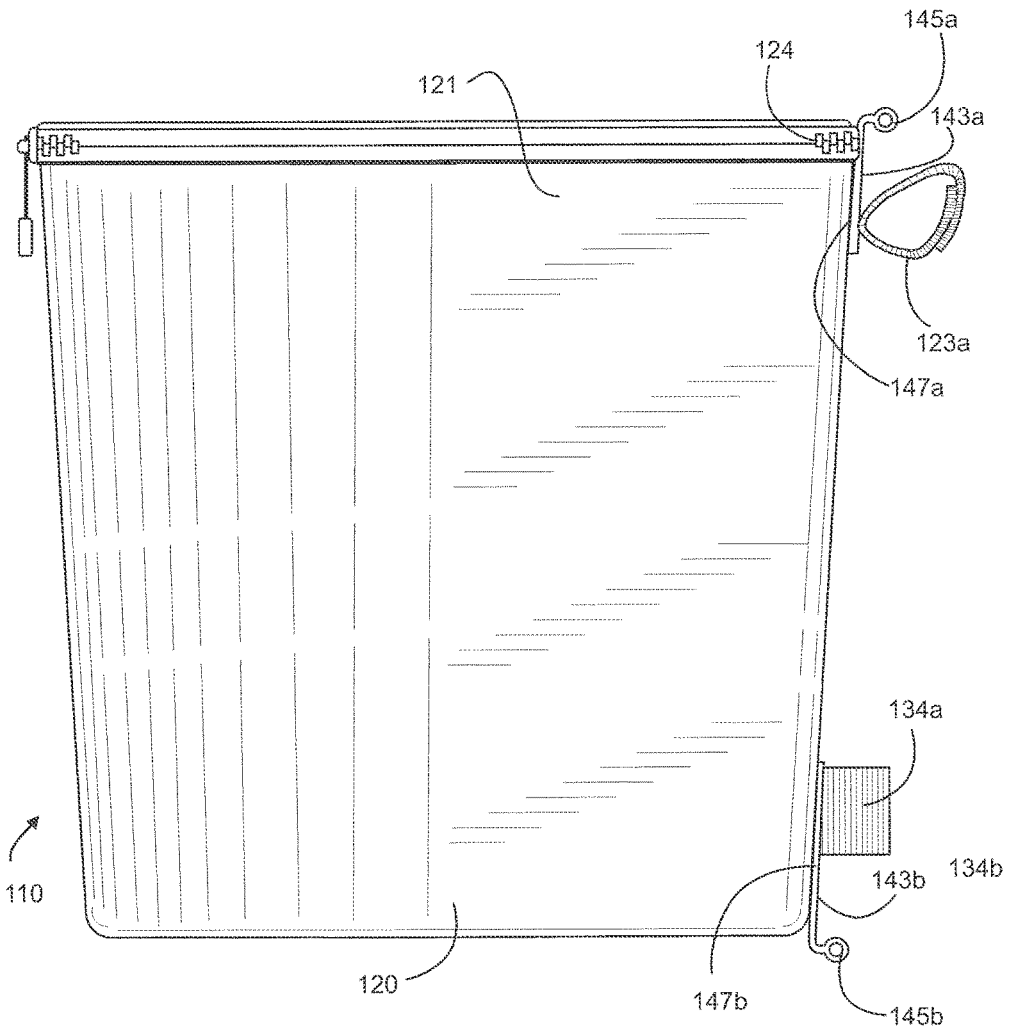
FIG. 12 is a side elevation view of an alternate embodiment of a waste receptacle depicting an attachment strap.
Figure 13:
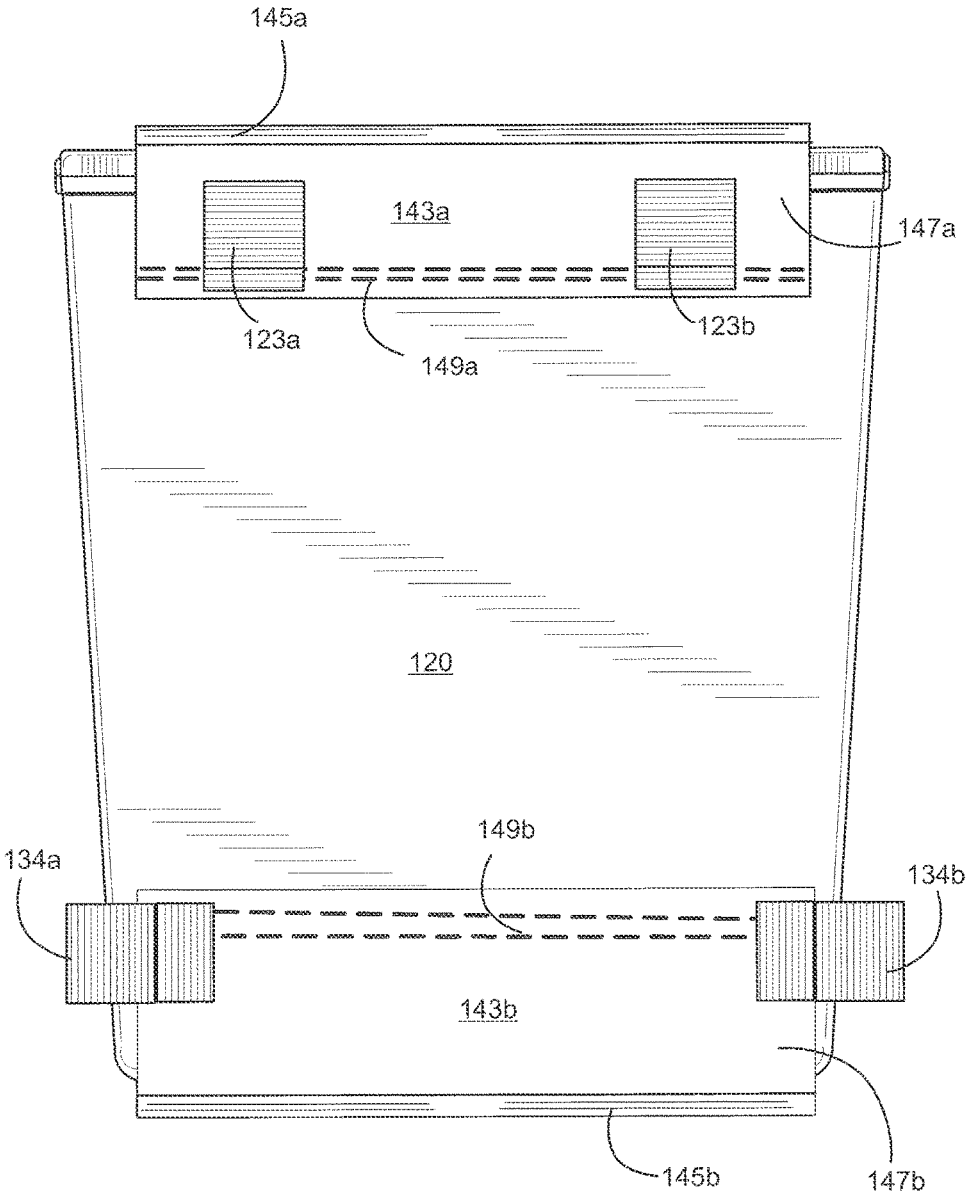
FIG. 13 is a back view of the receptacle of FIG. 12.
Figure 14A:
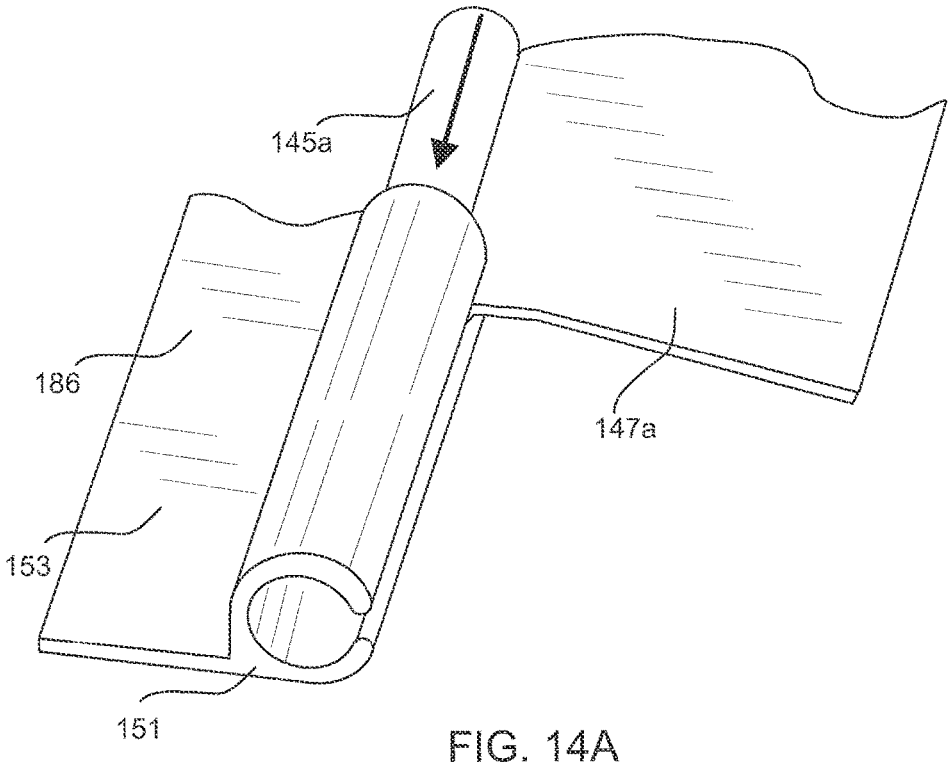
FIG. 14A is a perspective view of the attachment strap of FIG. 12 prior to insertion into a female clip.
Figure 14B:
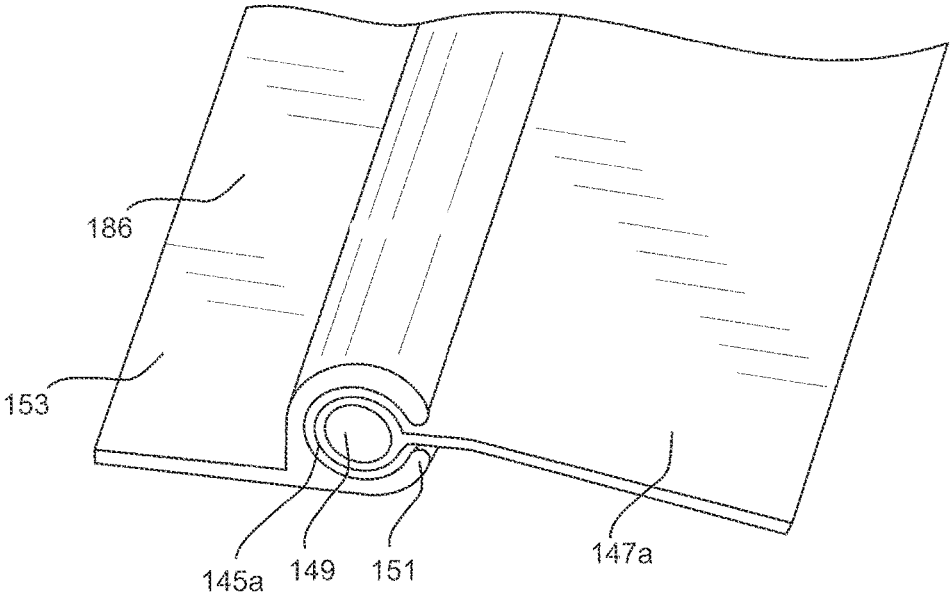
FIG. 14B is a perspective view of the attachment strap of FIG. 12 fully mated to the Female.

FIG. 12 depicts the receptacle 110 having an exterior bag 120. Attached to the exterior/outer bag 120 are first strap 123*a*, a second strap 134*a* and a third pair of straps 143*a, b*. Each of the attachment straps 143*a, b* includes a male slider 145*a, b* and a strap body 147*a, b*. As shown in FIG. 13, the third strap 143*a, b* is attached across the back panel of the outer bag 120 via seam 149*a, b*. Due to the width of each attachment strap 143*a, b* allowing for at least a half inch body 147*a, b* between the seam 149*a, b* and male slide 147; the strap 143*a, b* may flap and be pulled away from the back side of the outer bag back wall 120, so that the male slide 145*a, b* can be manipulated and oriented to slide into a female track (see FIGS. 14A, B) In an embodiment, the male slider 145*a, b* includes a rope 149 (FIG. 14B) inserted within the male slide 145*a, b*. In an embodiment, the attachment strap includes a Keder type system.

Figure 15:
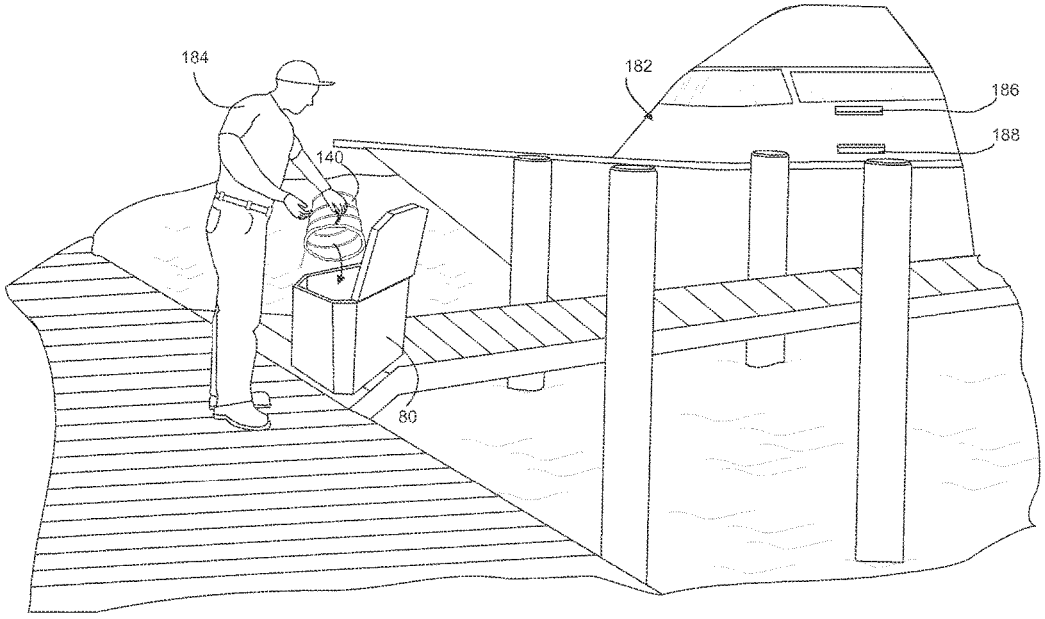
FIG. 15 is a depiction of an environment where the receptacle may be used and depicting rails on a boat where the receptacle may be attached.

FIG. 15 depicts a boat/vessel having a pair of rails 186, 188 attached to a side wall of the boat. The receptacle 110 may be quickly and easily attached to the boat by simultaneously sliding the male slides 145*a, b* into the corresponding female tracks 151. For example, top attachment strap may be slid into top rail 186 and bottom attachment strap may be slid into bottom rail 188. The rails 186, 188 include track body 153 for mounting to the boat so it may be understood that the present invention provides multiple attachment straps that allow for the attachment of the receptacle 110 to a boat or other vehicle in multiple ways, as discussed previously. The attachment straps also provide for the attachment of peripheral items to the receptacle, as discussed previously.

What is claimed:

1. A trash receptacle comprising:

an outer bag having a flexible construction forming an opening at a top side and at least a pair of first and second upper straps capable of attaching the receptacle to a rail;

a lid attached at a top of the outer bag to close the opening;

an inner bag having a backbone circumferentially disposed around the inner bag to help maintain the inner bag in a generally upright position, the inner bag insertable through the opening of the outer bag;

a pull string disposed at the top of the inner bag being capable to cinch the top of the inner bag closed;

a buoyant float member including a foam insert disposed in the outer bag;

a third strap disposed on the outer bag; and wherein the lid includes a slit having flexible sides, the slit capable of being stretched apart in order to allow for insertion of waste into the interior of the outer bag and to be received by the inner bag, the flexible sides movable between an open and closed position and the sides automatically retractable to the closed position.

2. The receptacle of claim 1 wherein the first, second and third straps allow for attachment means.

3. The receptacle of claim 2 wherein the first, second and third straps include a fastener.

4. The receptacle of claim 1 wherein backbone is a plastic or metal wire that is sewn to the inner bag.

5. The receptacle of claim 1 wherein the float member is secured into bottom of the outer bag.

6. The receptacle of claim 1 wherein the slit includes a resilient member disposed along each side of the slit, the slit capable of being stretched apart by at least 1 inch in order to allow for insertion of waste into the interior of the outer bag.

7. The receptacle of claim 1 further comprising an elastic band disposed across the exterior of the outer bag and capable to maintain the outer bag in a collapsed condition.

8. The receptacle of claim 1 further comprising a pair of lower straps located along a base of the outer bag.

9. The receptacle of claim 8 where the pair of straps include fasteners for holding the sides of the straps together and to clamp onto a post or a rail.

10. The receptacle of claim 8 wherein the pair of straps form a generally cylindrical area capable of receiving a rail or other mounting member therein and the cylindrical area having an axis disposed in a generally vertical orientation with respect to the receptacle.

11. The receptacle of claim 1 wherein the pair of upper straps form a generally cylindrical area capable of receiving a rail or other mounting member therein and the cylindrical area having an axis disposed in a generally horizontal orientation with respect to the receptacle.

12. The receptacle of claim 1 further comprising a band disposed at the bottom of the outer bag and for maintaining the buoyant member within the outer bag.

13. The receptacle of claim 1 further comprising a rigid plate disposed on a back panel of the outer bag.

14. The receptacle of claim 1 further comprising a zipper disposed along a top edge of the opening of the outer bag in order to fasten the lid in a closed condition.

15. The receptacle of claim 14 further comprising at least a pair of zipper pulls for opening and closing the zipper.

16. The receptacle of claim 1 further comprising a locating device disposed within the receptacle including one of a transmitter, light emitting device and reflector so that the receptacle may be more easily located if the receptacle is floating in water.

17. A receptacle assembly comprising:

an outer bag having a lid attached at a top of the outer bag to close an opening at the top of the bag, the outer bag formed from a flexible material capable of orienting the outer bag between a collapsed and upright condition;

an inner bag formed of a flexible nylon material, the inner bag insertable through the opening of the outer bag;

a buoyant float member disposed in the outer bag;

an attachment strap disposed at the top of the outer bag; and wherein the lid being hingedly attached to the outer bag, the lid including a slit having flexible sides including a resilient member disposed along each side of the slit, the slit capable of being stretched apart in order to allow for insertion of waste into the interior of the outer bag and to be received by the inner bag, the flexible sides movable between an open and closed position and the sides retractable to the closed position.

* * * * *